United States Patent [19]

Rao

[11] Patent Number: 4,544,422

[45] Date of Patent: Oct. 1, 1985

[54] FERRITE-AUSTENITE DUAL PHASE STEEL

[75] Inventor: Bangaru V. N. Rao, Bridgewater, N.J.

[73] Assignee: General Motors Corporation, Detroit, Mich.

[21] Appl. No.: 595,727

[22] Filed: Apr. 2, 1984

[51] Int. Cl.[4] ..... C21D 1/18

[52] U.S. Cl. ..... 148/142; 148/144

[58] Field of Search ..... 148/12 F, 12.4, 36, 148/143, 144, 12 R, 12.3, 12.1; 75/123 N

[56] References Cited

U.S. PATENT DOCUMENTS

| | | | |
|---|---|---|---|
| Re. 28,645 | 12/1975 | Aoki et al. | 148/12 F |
| 3,860,456 | 1/1975 | Repas | 148/12 F |
| 4,033,789 | 7/1977 | Hamburg et al. | 148/12 F |
| 4,047,979 | 9/1977 | Grange et al. | 148/12 R |
| 4,067,756 | 1/1978 | Koo et al. | 148/144 |
| 4,072,543 | 2/1978 | Coldren et al. | 148/12 F |
| 4,129,461 | 12/1978 | Rashid | 148/12.3 |
| 4,296,919 | 10/1981 | Sakurai et al. | 266/111 |

FOREIGN PATENT DOCUMENTS

| | | | |
|---|---|---|---|
| 141165 | 4/1980 | Fed. Rep. of Germany | 148/12.3 |
| 143930 | 9/1980 | Fed. Rep. of Germany | 148/12.4 |
| 44551 | 3/1980 | Japan | 148/12 F |
| 44722 | 4/1981 | Japan | 148/12.4 |
| 444819 | 11/1974 | U.S.S.R. | 148/12.4 |

OTHER PUBLICATIONS

Koo et al., "Thermal Cycling Treatments and Microstructures for Improved Properties of Fe-0.12C-0.5Mn Steels", Materials Science and Engineering, 24 (1976) 187-198.

Rashid, "Dual Phase Steels", Ann. Rev. Mate. Sci. 1981, 11, pp. 245-266.

Koo et al., "Design of Duplex Fe/X/0.1C Steels for Improved Mechanical Properties", vol. 8, Mar. 1977, pp. 525-528, Metallurgical Transactions A.

Furukawa et al., "Structure Formation and Mechanical Properties of Intercritically Annealed or As-Hot--Rolled Dual Phase Steels", *Fundamentals of Dual--Phase Steels*, AIME, Warrendale, Pa., 1981, pp. 221-248.

*Primary Examiner*—Peter K. Skiff

*Attorney, Agent, or Firm*—Douglas D. Fekete

[57] ABSTRACT

A microalloy-free, high strength, low alloy, low carbon, manganese steel characterized by a dual phase microstructure wherein acicular retained austenite particles are distributed within a ferrite matrix. The ferrite-austenite microstructure is produced by a heat treatment comprising heating the steel above the upper critical austenite transformation temperature to produce an austenite microstructure; quenching to produce a lath martensite microstructure; tempering at a temperature below the lower critical austenite transformation temperature to partition carbon and manganese to form cementite particles and to transform the martensite to ferrite, thereby producing a microstructure comprising cementite particles dispersed within a ferrite matrix; annealing at an intercritical temperature to decompose the cementite and produce austenite particles; and quenching to retain the austenite particles within the ferrite matrix.

3 Claims, 4 Drawing Figures

FERRITE-AUSTENITE DUAL PHASE STEEL

BACKGROUND OF THE INVENTION

This invention relates to a high strength, low alloy, dual phase steel having an improved combination of formability and high product strength. More particularly, this invention relates to a microalloy-free, low carbon, manganese steel characterized by a ferrite matrix microstructure comprising dispersed particles that are initially austenite, but transform to martensite during a forming operation. This invention also relates to a heat treatment for low carbon, manganese steel to form the initial ferrite-austenite microstructure.

Dual phase steel is high strength, low alloy steel that is characterized by a matrix microstructure composed of a continuous ferrite phase having a second phase distributed therein. In conventional dual phase steel, the second phase is martensite, although austenite or bainite may also be present, in which case the steel may include more than the two iron metallurgical phases strictly implied by its name. Dual phase steel is used, for example, in the manufacture of cold-formed sheet steel articles. The composite microstructure produces an advantageous combination of mechanical properties that allow the steel to be readily formed, but to develop a high formed strength. Although several factors are involved in achieving these advantageous properties, the high formability is attributed in part to the high ductility of the ferrite matrix, while the dispersed martensite reinforces the matrix to help develop the high product strength. Typically, the ferrite-martensite microstructure is produced by a heat treatment that includes in a final anneal at an intercritical temperature whereat ferrite and austenite phases coexist, followed by cooling, during which austenite transforms to create the dispersed martensite phase.

One example of a dual phase steel is referred to in the industry as GM 980X. GM 980X is a low-carbon, manganese steel that includes a small but critical vanadium addition. Although the basis of a ferrite-martensite dual phase microstructure is produced in GM 980X after an intercritical heat treatment, it has been found that a portion of the austenite does not transform during cooling, but is retained in the microstructure. Under low strain such as experienced during a forming operation, this retained austenite transforms to additional martensite. The retained austenite improves formability, at least partly by reducing yield strength and increasing plasticity. In addition, the increase in martensite during forming further reinforces the steel to thereby increase product strength.

Thus, the nonferrite constituent initially in GM 980X is mostly martensite, but includes significant retained austenite capable of strain-induced transformation during a subsequent forming operation. The formation of this initial microstructure, including the metastable retained austenite, is attributed in large part to the presence of the microalloy vanadium addition. However, vanadium, even in microalloy quantities, significantly increases steel cost. Heretofore, only minor quantities, if any, of retained austenite have been found in microalloy-free dual phase steel. For example, Koo et al, "Thermal Cycling Treatments in Microstructures for Improved Properties of Fe—0.12% C—0.15% Mn Steels", *Materials Science and Engineering* 24 (1976), pp. 187–198, describes a microalloy-free, low-carbon, manganese dual phase steel wherein the dispersed constituent is predominantly martensite, but includes retained austenite closely associated with the martensite. The minor proportion and martensite affiliation of this austenite indicates that any effect upon the steel properties is minimal, particularly in comparison to the martensite initially present in the steel.

It is an object of this invention to provide a microalloy-free, low alloy, low carbon, manganese steel having a dual phase microstructure wherein the dispersed constituent is predominantly retained austenite, which retained austenite cooperates with the ferrite matrix initially to improve formability, but undergoes strain-induced transformation to martensite during a forming operation to increase product strength. The high proportion, distribution and morphology of the retained austenite contribute to its particular effectiveness in improving the desired steel properties. The improved combination of high form-ability and high product strength is particularly advantageous in the manufacture of sheet steel articles and the like, but is achieved without the expense of a microalloy agent.

It is also an object of this invention to provide a heat treatment process for a microalloy-free, low carbon, manganese steel to form a ferrite-austenite dual phase microstructure. This process is applicable to steels having a conventional composition, including standard grade steels. By developing the dual phase microstructure, the process of this invention improves steel formability and product strength.

SUMMARY OF THE INVENTION

These and other objects are accomplished by heat treating a particular class of microalloy-free, high strength, low alloy steel to produce a dual phase microstructure wherein the dispersed constituent is predominantly retained austenite.

A preferred steel comprises 0.1 to 0.25 weight percent carbon, 1.5 to 2.5 weight percent manganese, and the balance substantially iron. Standard grades of carbon-manganese steel typically also include a small silicon addition for deoxidation, which silicon may enhance formation of the desired microstructure.

In accordance with a preferred three stage heat treatment, the steel is initially heated above the upper austenite transformation temperature, $A_3$, to dissolve the alloying constituents into the iron and to produce an essentially austenite microstructure. Upon quenching, the austenized steel forms a lath martensite microstructure. This lath martensite is tempered at a temperature below the lower critical austenite transformation temperature, $A_1$, for a time sufficient to partition carbon and manganese to the lath boundaries. The concentration of these elements at the boundaries produces relatively fine, lenticular cementite particles. Concurrently the martensite is transformed to ferrite. The tempered steel is subjected to an intercritical anneal at a temperature between the $A_1$ and the $A_3$ temperatures for a time sufficient to nucleate austenite particles that consume the cementite particles. The austenite grain is retained in the steel after cooling. However, the bulk of the ferrite remote from the dissolving cementite is not significantly affected by the final anneal and forms the basis of the desired continuous phase in the microstructure.

Thus, the intercritically annealed steel is characterized by a dual phase microstructure comprising retained austenite distributed within a continuous ferrite matrix. The ferrite phase preferably forms about 78 to 82 percent of the total volume. Of the remaining 18 to 22 percent, preferably at least 70 volume percent, and as much as 80 volume percent, is retained austenite. This retained austenite is principally in the form of relatively fine, acicular particles located at ferrite grain boundaries. This distribution and morphology is attributed to the manner in which the austenite grains are formed at the precursor lath martensite boundaries by the limited dissolution of the transient cementite particles and is believed to increase the effectiveness of the retained austenite. When the steel is subjected to a subsequent forming operation, the retained austenite initially enhances the formability of the steel, in part by reducing yield strength and increasing plasticity, but transforms during forming to martensite that reinforces the formed steel to increase product strength.

DETAILED DESCRIPTION OF THE INVENTION

Figure 1:
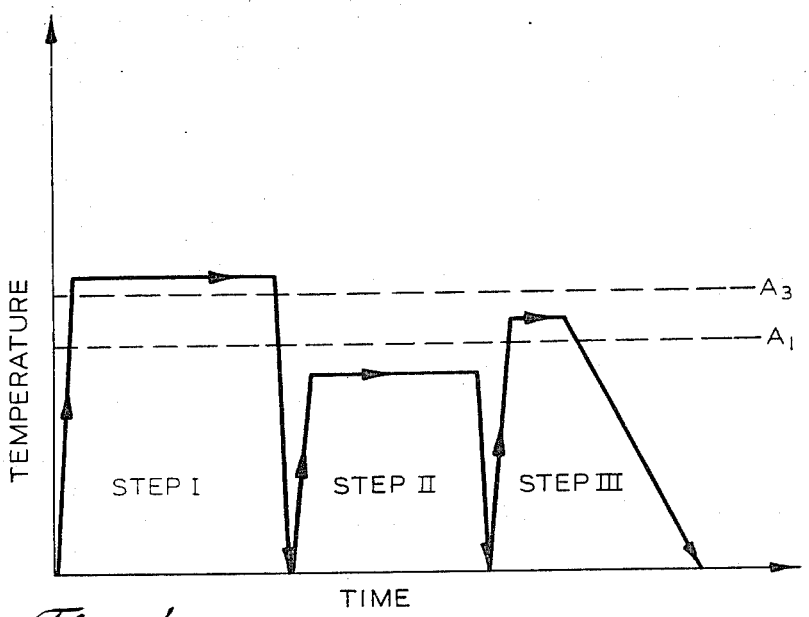
FIG. 1 is a schematic diagram showing temperature and time for a preferred heat treatment sequence for developing a ferrite-austenite dual phase steel in accordance with this invention.

In a preferred embodiment of this invention, a standard grade, high strength, low alloy carbon steel is heat treated to produce the austenite-ferrite dual phase microstructure and thereby improve the mechanical properties of the steel. A preferred steel composition comprises, by weight, 0.16 percent carbon, 1.5 percent manganese, 0.38 percent silicon, 0.016 percent phosphorus, 0.025 percent sulfur, less than 0.001 percent aluminum and the balance substantially iron, but is essentially free of microalloy constituents such as vanadium. This steel composition is classified AISI 1320 grade and has a conventional ferrite-pearlite microstructure in the as-received condition prior to heat treatment in accordance with this invention.

In order to obtain reliable metallurgical data, this invention was demonstrated on tensile stress specimens of the type described for ASTM Standard E8, Tension Testing of Metallic Materials. Commercial rolled sheet stock about 2 millimeters thick was cut into suitable blanks. Both major faces were ground to reduce the thickness to about 1.25 millimeters, thereby removing any surface oxides that might otherwise affect the metallurgical results. The ground blanks were machined to produce tensile specimens having slightly substandard dimensions. The tensile test axis ran parallel to the sheet stock rolling direction. The machined specimens were copper flashed to minimize decarburization during processing.

In accordance with this invention, the test specimens were heat treated to develop the ferrite-austenite dual phase microstructure. All heating steps were carried out in a neutral salt pot. A preferred heat treatment included the following steps:

(1) The specimens were heated to a temperature of about 870° C. for about one hour to produce an essentially austenite microstructure.

(2) The hot austenized specimens were water quenched to produce a lath martensite microstructure.

(3) The martensite steel was tempered at a temperature of about 700° C. for a period of about one hour to produce a ferrite microstructure containing cementite particles.

(4) The temper was terminated by water quenching. This quench controlled the duration of the temper, but did not significantly alter the microstructure.

(5) Tempered specimens were then subjected to an intercritical anneal. Some specimens were heated at a temperature of 800° C. Other specimens were heated at 845° C. Time at temperature was between 2 to 4 minutes. At the site of the cementite particles, this anneal dissolved the cementite and formed austenite particles. However, except for formation of the austenite particles, the ferrite phase within the steel was not significantly affected.

(6) The annealed specimens were then cooled to room temperature at a rate sufficient to avoid transformation of the austenite. Two cooling methods were evaluated. Selected specimens were cooled by ambient air forcefully blown over the specimen. Other specimens were quenched by immersion in a hot oil bath maintained at 99° C.

The overall heat treatment is shown schematically in FIG. 1. In the Figure, $A_3$ indicates the upper critical austenite transformation temperature, that is, the temperature above which the steel exists at equilibrium substantially as austenite. For the described steel compositions, $A_3$ is approximately 860° C. $A_1$ indicates the lower critical austenite transformation temperature, which is the temperature at which an equilibrium austenite phase commences to form upon heating. $A_1$ is approximately 710° C. for the described steel. The region between $A_1$ and $A_3$ is referred to as the intercritical region. Within this region, both austenite and ferrite phases coexist at equilibrium, their relative proportions depending upon the specific temperature. As can be seen from the Figure, the described treatment comprises three heating stages: first above the $A_3$ temperature, then below the $A_1$ temperature, and finally at an intercritical temperature.

Specimens treated in accordance with the described heat treatment were subjected to tensile tests in accordance with ASTM Standard E8. The copper flash was stripped prior to testing. Testing was carried out using an Instron tensile testing machine using a 25 millimeter gage length extensometer and a crosshead velocity of about 0.2 centimeter per minute. Test results are set forth in Table I. The table also indicates the intercritical anneal temperature, time and cooling technique for each specimen. FAC and HOQ indicate forced air cooling and hot oil quench, respectively.

TABLE I

| Mechanical Properties of Ferrite-Austenite Dual Phase Specimens | | | | | | | |
|---|---|---|---|---|---|---|---|
| | Intercritical Anneal Conditions | | | Yield | Ultimate Tensile | | |
| Specimen | Temperature in °C. | Time in Min. | Cooling Method | Strength in MPa | Strength in MPa | % Uniform Elongation | % Total Elongation |
| 1 | 800 | 2 | FAC | 362 | 705 | 28.9 | 37.1 |
| 2 | 800 | 2 | HOQ | 359 | 754 | 25.0 | 31.4 |
| 3 | 800 | 3 | FAC | 372 | 700 | 29.0 | 38.4 |
| 4 | 800 | 4 | FAC | 336 | 677 | 28.7 | 38.6 |
| 5 | 845 | 2 | HOQ | 461 | 807 | 20.0 | 27.2 |

Figure 2:
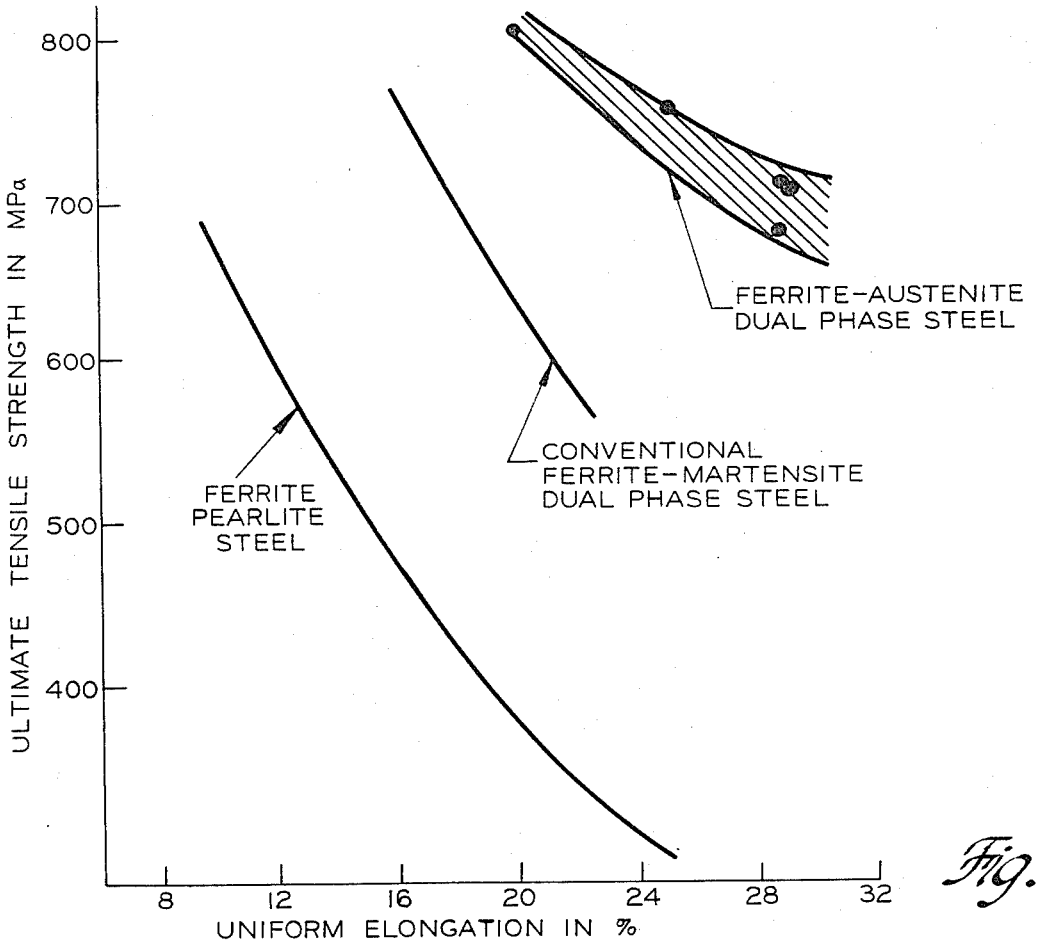
FIG. 2 is a graph of ultimate tensile strength and uniform elongation for ferrite-austenite dual phase steel of this invention and, for comparison, for plain carbon steel and conventional ferrite-martensite dual phase steel.

The ultimate tensile strength and uniform elongation data in Table I are illustrated graphically in FIG. 2. For comparison, the Figure shows representative values for ferrite-pearlite steel, such as is typical of the described AISI 1320 steel in the as-received condition, and for GM 980X dual phase steel. As can be seen, the ferrite-austenite dual phase steels of this invention exhibit a superior combination of ductility and tensile strength. The high ductility and low yield strength of the ferrite-austenite dual phase steel indicate improved formability. The high ultimate tensile strength demonstrated by the steel during testing indicates high strength in a formed product. One parameter having a particularly noteworthy effect upon the properties was the cooling rate following the intercritical anneal. In comparison to hot oil quench, the slower forced air cooling increased elongation but reduced strength.

Figure 3:
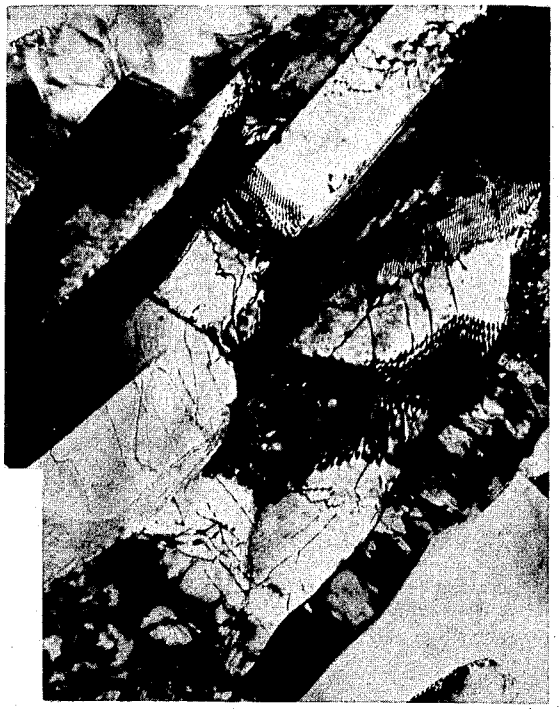
FIG. 3 is a bright-field transmission electron micrograph of a preferred ferrite-austenite dual phase microstructure of this invention.
Figure 4:
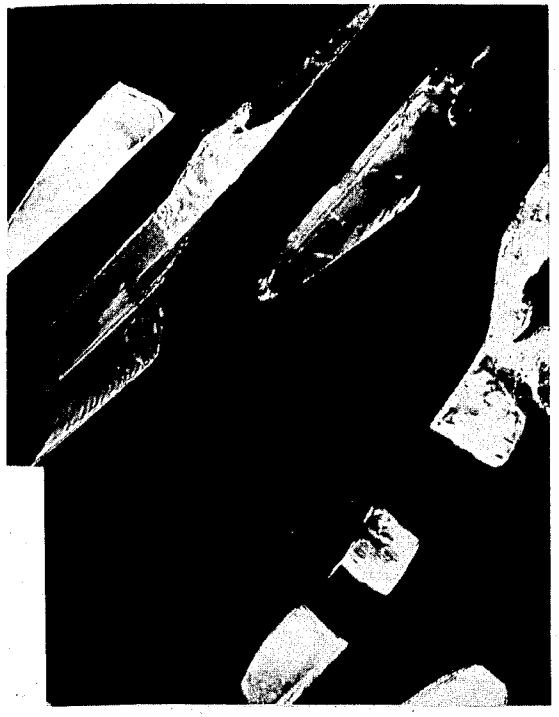
FIG. 4 is a dark-field transmission electron micrograph of the field in FIG. 3 wherein the dispersed austenite phase is highlighted.

FIGS. 3 and 4 are transmission electron photomicrographs of a sample of the described sheet steel heat treated in a manner corresponding to Specimen I in the table. After heat treatment, the sample was prepared by grinding both major surfaces under flood cooling, thinning using a hydrogen peroxide-hydrofluoric acid solution and jet electropolishing using a chromic acid-acetic acid solution to produce a thin foil representing an interior planar section parallel to the major surfaces of the sheet stock. FIGS. 3 and 4 show the same region under bright-field and dark-field conditions, respectively. Magnification is about 25,000x. In FIG. 4, the austenite is highlighted and contrasts with the dark ferrite.

FIGS. 3 and 4 show a preferred ferrite-austenite dual phase microstructure of this invention. As clearly indicated by the dark areas in FIG. 4, the major portion of the microstructure is ferrite. Analysis of this and several other regions of this sample indicate that about 80 volume percent of the total microstructure is ferrite. Austenite particles, highlighted in FIG. 4, are distributed within the ferrite matrix. About 16 volume percent of the steel is austenite. Miscellaneous iron phases such as martensite and bainite account for less than 4 percent. Furthermore, the majority of the austenite particles exhibit an acicular or lath-like morphology, which is particularly discernable in the lower portions of FIGS. 3 and 4. Only minor amounts of fine, spherical austenite or blocky austenite are found.

Transmission electron microscopic analysis of other samples of the specified steel heat treated in accordance with the described embodiment indicate similar ferrite-austenite dual phase microstructures. In general, it is estimated that the ferrite phase constitutes from about 75 to about 82 volume percent of the steel. Between about 78 and 82 volume percent is believed to be preferred to develop optimum mechanical properties in the steel. In steel that is forced air cooled, it is believed that at least 70 volume percent of the dispersed constituent is austenite. For hot oil quenched steel, the retained austenite content is believed less, perhaps about 50 percent, which may account for the reduced elongation found for these specimens. In any event, the major portion of the dispersed austenite particles exhibit an acicular morphology such as shown in FIGS. 3 and 4.

In addition to an acicular morphology, the dispersed austenite is also characterized by particular martensite transformation properties. The martensite transformation temperature in the absence of strain, $M_S$, is preferably near or below room temperature to prevent transformation during cooling. Thus, the austenite formed during the intercritical anneal is retained during cooling. However, the martensite transformation temperature during deformation, $M_D$, is preferably near or just above room temperature. As a result, the retained austenite converts to martensite during a cold-forming operation such as is typically used to fabricate sheet steel articles. It is believed that as much as 80 percent of the austenite may transform under conditions comprising relatively low strain. Martensite transformation is accompanied by an increase in plasticity. This transformation-induced plasticity (TRIP) improves the formability of the steel. In addition, the martensite is a relatively hard phase and reinforces the post-deformation microstructure to increase strength of the product steel.

The formation of the ferrite-austenite dual phase microstructure, and the proportion, morphology and martensite transformation properties of the dispersed retained austenite particles, are believed to be related to the steel composition and the heat treatment procedure. Steels suitable for the practice of this invention are considered to be high strength, low alloy, low carbon steels that contain manganese and optionally silicon. In general, an ultimate tensile strength in excess of 650 megaPascals is desired. By low alloy steel, it is meant that less than 3 weight percent of the total composition is nonferrous. By low carbon steel, it is meant that the carbon content is sufficiently low to avoid formation of an equilibrium cementite phase during intercritical anneal. A carbon content between 0.1 and 0.6 weight percent is believed suitable. Below 0.1 percent, the martensite phase in the formed steel is insufficient to produce the desired product strength. The carbon is preferably between about 0.1 and 0.25 weight percent, since higher carbon tends to overstabilize the austenite and thereby reduce martensite transformation during deformation.

Manganese possesses properties as a mild carbon getter (carbon affinity greater than that of iron) that significantly contributes to formation of the desired retained austenite. During the described heat treatment, manganese is concentrated with carbon in the dispersed particles in an amount sufficient to produce austenite having the desired martensite transformation properties. That is, the $M_S$ and $M_D$ temperatures of the austenite formed during the intercritical anneal are dependent upon the concentrations of manganese and gettered carbon therein, which in turn is related to an optimum volume fraction of austenite for steel of a particular manganese content. At least about 1 weight percent manganese is necessary to produce sufficient dispersed austenite in the annealed steel, and thus martensite in the formed steel, to develop the desired high product strength. A manganese content between 1.5 to 2.5 weight percent is preferred. Above 2.5 percent, the cost and other properties of the steel are generally suited only for specialty applications.

The steel preferably contains silicon. Silicon increases ferrite carbon activity to drive carbon into the austenite phase during intercritical annealing. Although the commercial steel in the described embodiment contained about 0.4 percent silicon, it is believed that a greater silicon concentration up to about 1.25 weight percent may be desirable.

The balance of the steel is substantially iron and impurities. The principal impurities are residual amounts of phosphorus, sulfur and aluminum normally found in commercial low carbon steel. However, the steel is essentially free of vanadium, titanium, niobium or similar carbonitride-forming alloying agents that are added to some steel in small amounts on the order of a fraction of a percent to increase strength. Despite the absence of such microalloy agent, the low carbon steel of this invention exhibits high strength as a result of martensite reinforcement of the steel after working, while also displaying improved formability.

While not limited to any particular theory, the superior combination of mechanical properties exhibited by steel having the ferrite-austenite microstructure is attributed not only to the high proportion and martensite transformation properties of the retained austenite, but is also enhanced by the manner in which the austenite particles are distributed in the ferrite matrix. This distribution is related to the heat treatment that forms the dual phase microstructure.

The steel is initially heated above the upper critical temperature, $A_3$, to dissolve the manganese and carbon into iron and form a homogeneous austenite solid solution. Upon quenching, the austenite transforms to a dislocated lath martensite microstructure wherein the manganese and carbon are distributed relatively uniformly.

The martensite is tempered to partition manganese and carbon to the lath boundaries and to form there fine, lenticular cementite particles. The cementite particles contain a disproportionately high concentration of manganese. For the described steel having an overall manganese content of about 1.5 weight percent, it has been found that the cementite particles contain greater than 10 percent manganese. Concurrently, the bulk of the martensite transforms to ferrite to form the basis for the matrix. Tempering is carried out below the lower critical temperature, $A_1$, to avoid premature austenite formation which, if allowed to occur, would interfere with the desired formation of manganese-enriched particles and ferrite matrix. Although the $A_1$ temperature depends upon alloy composition, in general, a temperature between 650° C. and 725° C. is believed to effectuate the desired partitioning within a practical time on the order of one hour. Higher temperatures and longer times promote manganese partitioning, but also result in coarser cementite particles, whereas finer particles are preferred. In addition, tempering tends to adversely affect the ferrite matrix by promoting ferrite recrystalization and lath boundary relaxation. Thus, lower temperatures and shorter times are desired to reduce these effects and thereby optimize the mechanical properties of the matrix, which forms the majority of the microstructure. Increasing the carbon and manganese content in the steel is believed to enhance partitioning, while reducing ferrite recrystallization and boundary relaxation.

In the described embodiment, the steel is quenched following tempering to control the duration of the temper. This quench is not believed to significantly affect formation of the ferrite-austenite microstructure and may be eliminated.

During the final anneal, the steel is heated to an intercritical temperature. Equilibrium at this temperature would produce a stable microstructure consisting of coexisting ferrite and austenite phases. Although it is doubtful that equilibrium is achieved within the short time during which the steel is annealed, the anneal is believed to cause austenite grains to nucleate at the ferrite-cementite interphase. The cementite particles, which are not stable at the intercritical temperature, dissolve into the nascent austenite grains, causing the austenite grains to grow and inherit the alloying constituents from the cementite particle. This austenite growth is accelerated along the ferrite grain boundaries, which are derived from the precursor lath martensite boundaries, thus producing an acicular shape having a high aspect ratio.

As a result of this dissolution, the manganese and carbon concentrations within the austenite grain are reduced from the level found within the precursor cementite. The manganese concentration varies with the austenite grain, being generally greater near the center about the former site of the precursor cementite. However, in the described embodiment, it is estimated that an average manganese concentration within the austenite grain after anneal is approximately 5 weight percent. This is in part controlled by the duration of the intercritical heating. In the described embodiment, equal proportions of ferrite and austenite are predicted under equilibrium conditions at 800° C. However, the brief annealing time, 2 to 4 minutes in the described embodiment, limits manganese dissolution and the growth of the nascent austenite phase. Upon cooling following the anneal, the manganese concentration in the austenite grain is sufficiently low to prevent cementite from reforming but high enough to reduce the martensite transformation temperature, $M_S$, below ambient temperature and thereby permit the austenite to be retained in the cooled microstructure. As a result, upon cooling, the cementite does not reform, but rather the majority of the austenite formed during the anneal is retained in the microstructure.

The cooling rate following anneal may affect the proportion and properties of austenite retained in the microstructure. For thin sheet stock such as in the described embodiment, forced air cooling enhances retention of the austenite within the microstructure. Any austenite that transforms tends to form proeutectoid ferrite that adds to the matrix. Also, forced air cooling may encourage carbon migration into the retained austenite and increase its stability. Hot oil quenching of this sheet stock tends to cause a larger portion of the austenite to transform to martensite, thereby reducing the proportion of retained austenite. The resulting increased martensite fraction may account for the higher product strength but decreased ductility reported for the HOQ sheet specimens in Table I. However, hot oil quench may be preferred for more massive stock to achieve a cooling rate conducive to retaining a larger proportion of the austenite. In any event, the steel of this invention is characterized by a significant portion of retained austenite in the form of fine, acicular particles. In general, the retained austenite particles have a maximum linear dimension of much less than one micron and a high surface to volume ratio.

The intercritical anneal is not believed to substantially affect the bulk of the ferrite matrix formed during tempering. Thus, following the intercritical anneal, the microstructure comprises the retained austenite dispersed within the ferrite matrix. The presence of the retained austenite is believed to reduce yield strength particularly in comparison to conventional dual phase steel comprising martensite dispersed in a ferrite matrix. In addition, when the steel is worked, the retained austenite transforms to martensite in a manner that not only increases plasticity, and thus formability, but also reinforces the steel to increase strength. The effectiveness of the retained austenite is believed to be increased by the fine particle size, the high surface to volume ratio associated with the acicular shape, and the location at ferrite boundaries derived from the lath boundaries of the precursor martensite phase. These factors are believed to promote interaction between the dispersed phase and the matrix during forming of the steel.

While this invention has been disclosed principally with reference to formation of the ferrite-austenite dual phase microstructure for tensile test specimens, the combination of enhanced formability and high tensile strength makes the steel particularly useful in the manufacture of commercial products from sheet or other steel stock. For example, suitable commercial grade sheet steel may be heat treated in accordance with this invention to develop the ferrite-austenite microstructure to improve the manufacture of automotive panels therefrom.

Although this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A heat treatment process for manufacturing a microalloy-free, high strength, low alloy, low carbon steel characterized by a dual phase microstructure comprising austenite particles distributed within a ferrite matrix, said steel comprising between about 0.1 and 0.6 weight percent carbon, greater than about 1.0 weight percent manganese, optionally up to about 1.25 weight percent silicon, and the balance substantially iron and impurities, said process comprising (1) austenizing the steel at the temperature above the upper critical austenite transformation temperature, $A_3$, to produce a substantially austenite microstructure, (2) quenching the austenitic steel to form a lath martensite microstructure, (3) tempering the martensitic steel at a temperature below the lower critical temperature, $A_1$, to form a microstructure comprising cementite particles distributed within a ferrite matrix, (4) annealing the tempered steel at an intercritical temperature to decompose the cementite and form dispersed austenite particles, and (5) quenching the intercritically annealed steel at a rate sufficient to retain said dispersed austenite and thereby form said ferrite-austenite dual phase microstructure in said steel.

2. A heat treatment process for manufacturing a microalloy-free, high strength, low alloy, low carbon steel characterized by a dual phase microstructure comprising fine, acicular austenite particles distributed within a ferrite matrix, said steel comprising between about 0.1 and 0.25 weight percent carbon, between about 1.0 and 2.5 weight percent manganese, optionally up to about 1.25 weight percent silicon, and the balance substantially iron and impurities, said process comprising (1) heating the steel at the temperature above the upper critical austenite transformation temperature, $A_3$, for a time sufficient to produce a substantially homogeneous austenite microstructure, (2) quenching the austenitic steel to form a lath martensite microstructure, (3) heating the martensitic steel at a temperature between about 650° C. and 725° C. for a time sufficient to partition carbon and manganese to grain boundaries within the microstructure and to form a ferrite-base microstructure comprising manganese- and carbon-enriched cementite particles, (4) annealing the ferrite-base steel at an intercritical temperature between the $A_1$ and $A_3$ temperatures for a time sufficient to decompose the cementite and form dispersed austenite particles, whereupon said dissolution occurs preferentially along ferrite grain boundaries to produce acicular particles, and (5) quenching the intercritically annealed steel at a rate sufficient to retain said dispersed acicular austenite particles and thereby form said ferrite-austenite dual phase micro-structure in said steel.

3. A heat treatment process for manufacturing a microalloy-free, high strength, low alloy, low carbon sheet steel characterized by a dual phase microstructure comprising retained austenite particles distributed within a ferrite matrix, said ferrite matrix forming between about 75 and 82 volume percent of the total microstructure, said retained austenite forming at least 70 volume percent of the remainder and being predominantly fine, acicular particles, said steel consisting essentially of between about 0.1 and 0.25 weight percent carbon, between about 1.0 and 2.5 weight percent manganese, optionally up to about 0.4 weight percent silicon, and the balance substantially iron and impurities, said process comprising (1) heating the steel at the temperature above the upper critical austenite transformation temperature, $A_3$, for a time sufficient to dissolve the manganese and carbon uniformly within the iron and produce a substantially homogeneous austenite microstructure, (2) quenching the austenitic steel to form a lath martensite microstructure, (3) heating the martensitic steel at a temperature between about 650° C. and 725° C. for a time on the order of one hour to partition manganese and carbon to grain boundaries within the microstructure to form cementite particles and to transform the bulk of the martensite to ferrite, (4) heating the cementite-containing ferrite-base steel at an intercritical temperature between the $A_1$ and $A_3$ temperatures for a time up to about 4 minutes to decompose the cementite and form austenite particles that consume the constituents from the cementite, said austenite particles being dispersed in a ferrite matrix and preferentially forming along ferrite grain boundaries to produce predominantly acicular particles, and (5) forced air cooling the intercritically heated steel at a rate sufficient to retain said dispersed acicular austenite particles and thereby form said ferrite-austenite dual phase microstructure in said steel.

* * * * *